US008769976B2

(12) United States Patent
Thybo et al.

(10) Patent No.: US 8,769,976 B2
(45) Date of Patent: Jul. 8, 2014

(54) METHOD FOR CONTROLLING A REFRIGERANT DISTRIBUTION

(75) Inventors: Claus Thybo, Soenderborg (DK); Rafael Wisniewski, Broenderslev (DK)

(73) Assignee: Danfoss A/S, Nordborg (DK)

( * ) Notice: Subject to any disclaimer, the term of this patent is extended or adjusted under 35 U.S.C. 154(b) by 1164 days.

(21) Appl. No.: 12/663,040

(22) PCT Filed: Jun. 11, 2008

(86) PCT No.: PCT/DK2008/000213
§ 371 (c)(1),
(2), (4) Date: Jun. 15, 2010

(87) PCT Pub. No.: WO2008/151629
PCT Pub. Date: Dec. 18, 2008

(65) Prior Publication Data

US 2010/0242505 A1 Sep. 30, 2010

(30) Foreign Application Priority Data

Jun. 12, 2007 (DK) ..... 2007 00846

(51) Int. Cl.

| | |
|---|---|
| ***F25B 49/00*** | (2006.01) |
| ***F25B 41/04*** | (2006.01) |
| ***F25B 41/06*** | (2006.01) |
| ***F25D 23/12*** | (2006.01) |
| ***G05D 23/20*** | (2006.01) |

(52) U.S. Cl.
USPC ..... 62/225; 62/199; 62/200; 62/525; 62/528; 62/228.4; 62/175; 62/217; 62/259.2; 62/228.1; 62/115; 62/498; 62/80

(58) Field of Classification Search
USPC ..... 62/117, 199, 525, 504, 151–152, 81, 62/190, 200
See application file for complete search history.

(56) References Cited

U.S. PATENT DOCUMENTS 5,052,190 A 10/1991 Gregory
5,363,671 A 11/1994 Forsythe et al.

(Continued)

FOREIGN PATENT DOCUMENTS

DE 19547744 A1 6/1997
EP 0354037 A2 2/1990

(Continued)

OTHER PUBLICATIONS

'Numerical simulation of a variable speed refrigeration system,' by R. N. N. Koury, L. Machado and K. A. R. Ismail (published in International Journal of Refrigeration 24 (2001) 192-200).*

(Continued)

*Primary Examiner* — Frantz Jules
*Assistant Examiner* — Meraj A. Shaikh
(74) *Attorney, Agent, or Firm* — McCormick, Paulding & Huber LLP

(57) ABSTRACT

A method for controlling a refrigerant distribution in a vapour compression system, such as a refrigeration system, e.g. an air condition system, comprising at least two evaporators. The refrigerant distribution determines the distribution of the available amount of refrigerant among the evaporators. While monitoring a superheat, SH, at a common outlet for the evaporators, the distribution of refrigerant is modified in such a manner that a mass flow of refrigerant to a first evaporator is altered in a controlled manner. The impact on the monitored SH is then observed, and this is used for deriving information relating to the behaviour of the first evaporator, in the form of a control parameter. This is repeated for each evaporator, and the refrigerant distribution is adjusted on the basis of the control parameters. The impact may be in the form of a significant change in SH. Alternatively, the control parameter may reflect a change in SH occurring as a result of the modification of the distribution of refrigerant.

25 Claims, 5 Drawing Sheets

(56) References Cited

U.S. PATENT DOCUMENTS

| | | | | |
|---|---|---|---|---|
| 6,415,619 | B1 | 7/2002 | Bash et al. | |
| 6,449,968 | B1 * | 9/2002 | Singh et al. | 62/175 |
| 6,546,843 | B2 | 4/2003 | Ugolini | |
| 7,992,398 | B2 * | 8/2011 | Tiranno et al. | 62/225 |
| 2002/0124585 | A1 * | 9/2002 | Bash et al. | 62/228.4 |
| 2005/0172647 | A1 * | 8/2005 | Thybo et al. | 62/129 |
| 2006/0042276 | A1 * | 3/2006 | Doll et al. | 62/129 |
| 2006/0213208 | A1 * | 9/2006 | Iwaki et al. | 62/222 |
| 2008/0302238 | A1 * | 12/2008 | Drouart et al. | 95/20 |

FOREIGN PATENT DOCUMENTS

| | | | |
|---|---|---|---|
| GB | 1006037 | A | 9/1965 |
| GB | 2190180 | A | 11/1987 |
| GB | 2405688 | A | 3/2005 |
| JP | 2-21165 | A | 1/1990 |
| JP | 2-126052 | A | 5/1990 |
| JP | 10-274448 | A | 10/1998 |
| JP | 2001-4254 | A | 1/2001 |
| JP | 2001-221520 | A | 8/2001 |
| JP | 2001-272114 | A | 10/2001 |
| JP | 2002-31421 | A | 1/2002 |
| JP | 2007-33002 | A | 2/2007 |
| WO | 2006/097106 | A1 | 9/2006 |

OTHER PUBLICATIONS

'Superheat Stability of an Evaporator and Thermostatic Expansion Valve,' by M.J. Lenger, A.M. Jacobi and P.S. Hrnjak ACRC TR-138, Project 76, Jul. 1998.*

Lenger, M.J., Jacobi, A.M., Hrnjak, P.S., 'Superheat Stability of an Evaporator and Thermostatic Expansion Valve,' IDEALS, TR-138, Project 76, Jul. 1998.*

R.N.N. Koury, L. Machado and K.A.R. Ismail, 'Numerical Simulation of a Variable Speed Refrigeration System,' International Journal of Refrigeration 24 (2001) 192-200.*

International Search Report for PCT/DK2008/000213 dated Oct. 11, 2008.

* cited by examiner

METHOD FOR CONTROLLING A REFRIGERANT DISTRIBUTION

CROSS REFERENCE TO RELATED APPLICATIONS

This application is entitled to the benefit of and incorporates by reference essential subject matter disclosed in International Patent Application No. PCT/DK2008/000213 filed on Jun. 11, 2008 and Danish Patent Application No. PA 2007 00846 filed Jun. 12, 2007.

FIELD OF THE INVENTION

The present invention relates to a method for controlling a refrigerant distribution in a vapour compression system, such as a refrigeration system, comprising at least two evaporators. More particularly, the present invention relates to a method for controlling a refrigerant distribution among at least two evaporators in such a manner that the refrigeration capacity of the evaporators is utilised to the greatest possible extent.

BACKGROUND OF THE INVENTION

It is sometimes necessary to provide a vapour compression system in which two or more evaporators are fluidly connected in parallel between a compressor and a common outlet. This is, e.g., the case in many refrigeration systems comprising two or more separate refrigeration compartments, e.g. household refrigerators having a chilling compartment and a freezing compartment. Alternatively, two or more evaporators may be arranged in the same refrigerated volume, e.g. in a side by side configuration. An example of such a construction could be an air condition system. When two or more evaporators are fluidly coupled in parallel in this manner, a distribution of the available refrigerant between the evaporators must be obtained. It is desirable that the distribution takes various individual factors of the evaporators into consideration. Such individual factors may include individual set point temperatures, refrigeration load, efficiency, etc.

Various attempts to obtain a desired distribution of refrigerant in one of the vapour compression systems defined above have been tried. Thus, DE 195 47 744 discloses a refrigeration system comprising a compressor and two evaporators fluidly coupled in parallel to the compressor. The flow of refrigerant across both evaporators is controlled by means of an electrically controlled magnet valve. The valve is controlled on the basis of measurements of temperatures inside two separate compartments, each being refrigerated by one of the evaporators. Thus, the valve is controlled in such a manner that each evaporator receives a correct amount of refrigerant to obtain a proper hysteresis control of the corresponding refrigeration compartment. A disadvantage of this control method is that it requires a separate temperature sensor for each evaporator. Another disadvantage is that it can not be ensured that the potential refrigeration capacity of each evaporator is utilised to the greatest possible extent. Yet another disadvantage is that it is not suitable for use in a system where the evaporators are arranged in the same refrigerated volume, e.g. in an air condition system.

U.S. Pat. No. 6,546,843 discloses a machine for producing and dispensing cold or iced beverages comprising a plurality of beverage-containing tanks. Each tank is provided with an evaporator for a refrigerating circuit and a mixer. The evaporators are connected with one and the same compressor by connection and controlled shutoff valves. Flow of refrigerant to each of the evaporators is controlled on the basis of a measured temperature in each of the tanks. Valves controlling fluid flows to the individual evaporators may be controlled sequentially. It is necessary to position a temperature sensor in each of the tanks, and the other disadvantages described above are also present in this machine.

SUMMARY OF THE INVENTION

It is, thus, an object of the invention to provide a method for controlling a refrigerant distribution in a vapour compression system comprising two or more evaporators, the method being suitable for use in a vapour compression system having two or more evaporators arranged in the same refrigerated volume.

It is a further object of the invention to provide a method for controlling a refrigerant distribution in a vapour compression system comprising two or more evaporators, wherein the number of necessary components in the vapour compression system can be reduced as compared to similar prior art vapour compression systems.

It is an even further object of the invention to provide a method for controlling a refrigerant distribution in a vapour compression system comprising two or more evaporators, the method allowing the potential refrigeration capacity of each evaporator to be utilised in a more efficient manner than it is the case in similar prior art vapour compression systems.

According to a first aspect of the invention the above and other objects are fulfilled by providing a method for controlling a refrigerant distribution in a vapour compression system, the vapour compression system comprising a compressor, a condenser, at least two evaporators fluidly connected in parallel between the compressor and a common outlet, and means for controlling a flow of refrigerant across each of the evaporators, the method comprising the steps of:

a) monitoring a superheat, SH, of refrigerant at the common outlet,
b) modifying the distribution of refrigerant through the evaporators in such a manner that a mass flow of refrigerant through a first evaporator is altered while keeping the total mass flow of refrigerant through all the evaporators substantially constant,
c) when a significant change in SH occurs, detecting a control parameter based on the change in mass flow of refrigerant through the first evaporator obtained during step b),
d) repeating steps a) to c) for each of the remaining evaporator(s), and
e) adjusting the distribution of refrigerant through each of the evaporators on the basis of the detected control parameters.

In the present context the term 'vapour compression system' should be interpreted to mean any system in which a flow of refrigerant circulates and is alternatingly compressed and expanded, thereby providing either refrigeration or heating of a volume. Thus, the vapour compression system may be a refrigeration system, an air condition system, a heat pump, etc.

The compressor may be a single compressor, but it could also be two or more compressors, e.g. forming a compressor rack.

The vapour compression system comprises at least two evaporators arranged in parallel, preferably in such a manner that they provide refrigeration to the same refrigerated volume. The refrigerant distribution determines how an amount of available refrigerant is distributed among the evaporators.

The distribution of refrigerant through the evaporators is modified while the SH is monitored. The modification is performed in such a manner that a mass flow of refrigerant through a selected, here denoted a first, evaporator is altered in a specific and controlled manner. Since the total amount of available refrigerant is not altered, the mass flow of refrigerant through the remaining evaporators must be modified to compensate for the controlled modification of the mass flow through the first evaporator. However, the mutual distribution among the remaining evaporators is kept substantially constant.

When a significant change in SH occurs, a control parameter is detected. This control parameter will thereby be significant for the behaviour of the first evaporator in response to the performed modification. Thus, the control parameter provides information about operation and performance of that specific evaporator. For instance, let N be the number of evaporators. Then:

$$\text{Distribution}_{1,new}=\text{Distribution}_{1,old}+\Delta$$

and $$\text{Distribution}_{i,new}=\text{Distribution}_{i,old}-\Delta/(N-1),\ \text{for } i\neq 1$$

A significant change in SH could, e.g., be a sudden increase or decrease in SH. For instance, if the mass flow through the first evaporator is increased, then the SH will decrease significantly when the mass flow is sufficiently large to allow liquid refrigerant to pass all the way through the evaporator. Thus, when such a decrease in SH is detected, a control parameter is detected, and the control parameter thereby provides information about the behaviour of the first evaporator during such an event. Ideally the vapour compression system should be operated in such a manner that each of the evaporators receives exactly enough refrigerant to ensure that a mixed gaseous/liquid phase of the refrigerant is present along the entire length of the evaporator without allowing liquid refrigerant to pass through the evaporator. If this can be obtained, the performance of each of the evaporators will be optimal, and the total performance of the vapour compression system can thereby be optimised without increasing the total power consumption of the system. On one hand, a significant amount of gaseous refrigerant in the evaporator is undesirable because it adversely affects the heat transfer coefficient of the refrigerant, and the potential refrigeration capacity of the evaporator is thereby not utilised in an optimal manner. On the other hand, it is not desirable to allow liquid refrigerant to pass through the evaporator because this may cause damage to the compressor. Furthermore, allowing liquid refrigerant to pass through the evaporator causes an inefficient use of the potential refrigeration capacity of the refrigerant, since refrigeration occurs as a result of the refrigerant undergoing a phase change. In order to obtain that the potential refrigeration capacity of each of the evaporators is utilised to the greatest possible extent, it is primarily an objective to ensure that the evaporators have substantially identical degrees of filling. Once this has been obtained, it may subsequently be ensured that the mixed phase of the refrigerant is present along the entire length of each evaporator. This may, e.g., be obtained by adjusting the amount of available refrigerant.

By repeating steps a) to c) for each of the remaining evaporator(s), control parameters as described above are obtained for each of the evaporators. Since individual information is obtained for each of the evaporators, it is possible to use the obtained information for adjusting the refrigerant distribution in such a manner that individual characteristics for each evaporator are taken into account. Accordingly, a refrigerant distribution can be chosen which ensures that the potential refrigeration capacity of each of the evaporators is utilised to the maximum extent possible. This is a great advantage because the total power consumption of the vapour compression system may thereby be reduced without reducing the performance of the system.

Furthermore, the individual control parameters for each of the evaporators are obtained using the same measuring equipment, i.e. it is not necessary to install a set of relevant sensors for each of the evaporators. Thereby the component count for the system can be kept at a minimum, and the initial manufacturing costs are thereby also kept at a minimum.

Step b) may comprise gradually increasing a mass flow of refrigerant through the first evaporator. This may, e.g., be obtained by gradually opening a valve being fluidly connected to the evaporator. According to this embodiment the mass flow of refrigerant through the first evaporator is gradually increased, while gradually compensating this increase in mass flow by reducing the mass flow through each of the remaining evaporators, until a significant change in SH occurs. As described above, the significant change in SH is, in this case, preferably a significant decrease in SH which is prompted by liquid refrigerant being allowed to pass through the first evaporator.

The detected control parameter may be a difference in a degree of opening, e.g. in degree of opening of a valve as defined above. Thus, in this case the detected control parameter provides information about how much the mass flow of refrigerant through the first evaporator has been increased during the gradual increase. Preferably, the control parameter thus obtained provides information as to how much the degree of opening can be increased before liquid refrigerant passes through the evaporator.

Alternatively, the control parameter may be a length of a time interval elapsing until the significant change in SH occurs. This may advantageously be obtained in the following manner. The mass flow of refrigerant through the first evaporator is dramatically increased, e.g. by fully opening a valve being fluidly connected to the first evaporator. At the same time a timer is started, and when a significant change in SH, preferably a significant decrease in SH prompted by liquid refrigerant being allowed to pass through the evaporator, the time interval elapsed since the mass flow was increased is detected. Preferably, the control parameter thus obtained provides information as to how long it takes from fully opening a valve until liquid refrigerant passes through the evaporator.

The method may further comprise the step of repeating steps a) to e). According to this embodiment the refrigerant distribution is repeatedly adjusted, and it is thereby ensured that the refrigerant distribution remains optimal. Steps a) to e) may be repeated at predetermined time intervals, such as regularly every hour, every 15 minutes, every 5 minutes, etc., depending on expected variations in operating conditions for the vapour compression system. The steps may even be repeated continuously.

Alternatively, repetition of the method steps may be initiated by a superheat controller. According to this embodiment, the superheat controller may be capable of detecting signs indicating that the distribution of refrigerant among the evaporators is not optimal. This may, e.g., be that it is difficult for the superheat controller to keep the SH substantially constant. The superheat controller may, e.g., detect that the SH oscillates or cycles, i.e. that the variance of the SH increases. This may be an indication that at least one of the evaporators allows liquid refrigerant to pass through, at least periodically. Allowing liquid refrigerant to pass through one of the evaporators will cause an abrupt decrease in SH, and when liquid refrigerant no longer passes through the evaporator, the SH will abruptly increase again. Such a problem may be relieved by adjusting the distribution of refrigerant among the evaporators. Accordingly, it is advantageous if the superheat controller can 'request' an adjustment, i.e. initiate the method steps, if a situation as described above occurs. This may be regarded as the superheat controller requesting a distribution adaptation algorithm. As an alternative, the superheat controller may initiate the method steps if a known change in operating conditions occurs. For instance, if a flow of secondary fluid across the evaporators, e.g. a flow of air in the case that the vapour compression system is an air condition system, is altered, then the superheat controller may initiate the method steps in order to cause an adjustment of the distribution of refrigerant, the adjustment compensating such alterations being known to occur. It should be noted that it is not necessarily required that the exact values of such alterations are know. It may be sufficient to know that considerable alterations took place. In this case the initiation of the method steps may be regarded as part of a feed forward strategy.

Step a) may comprise monitoring a temperature, T, of refrigerant at the common outlet. According to this embodiment information relating to the behaviour of one of the evaporators can be obtained by means of a single temperature sensor arranged at the common outlet.

Alternatively or additionally, step a) may comprise monitoring a pressure, P, of refrigerant at the common outlet. The pressure, P, of refrigerant at the common outlet may be obtained by measuring a temperature of refrigerant at a common inlet of the evaporators. Alternatively, the pressure, P, may be measured directly.

The method may further comprise the steps of:

comparing the detected control parameters for each of the evaporators, and in the case that the detected control parameter of an evaporator is significantly different from the detected control parameters of the remaining evaporators, generating a failure warning signal to an operator.

If the control parameter of one of the evaporators differs significantly from the control parameter(s) of the remaining evaporator(s), or if it is simply significantly different from what is expected, this may be a sign that this evaporator is not functioning in a proper manner. The evaporator may, e.g., be failing, it may be dirty, or it may need defrost. In any event, generating a failure warning to an operator will draw the attention of the operator, and he or she may then investigate the cause of the difference in detected control parameters, and possibly take the necessary actions to solve any problem.

Thus, the method may further comprise the step of initiating defrost of the evaporator having a significantly different control parameter upon generation of a failure warning signal. This step may be initiated manually by an operator establishing that the generated failure warning signal is occasioned by a need for defrost of the evaporator in question. Alternatively, the step may be automatically initiated, e.g. in the case that the difference in control parameters fulfils certain criteria being known to indicate that defrost is needed. This opens the possibility of performing partial defrost of the vapour compression system by temporarily closing off the supply of refrigerant to the relevant evaporator while the remaining evaporators continue operating, preferably in such a manner that the total performance of the vapour compression system is not reduced, or is only reduced insignificantly. Thereby defrost can be performed without affecting the operation of the system.

Step e) may be performed by adjusting the distribution of refrigerant through each of the evaporators in accordance with a distribution defined by the detected control parameters. According to this embodiment the distribution of refrigerant may be adjusted in such a manner that the mass flow of refrigerant to an evaporator which is relatively far from optimal operation is adjusted more than the mass flow to an evaporator which is relatively close to optimal operation. Thereby the adjusted distribution of refrigerant comes closer to ensuring an optimum utilisation of the potential refrigeration capacity of all of the evaporators.

Alternatively or additionally, step e) may comprise:

selecting one of the evaporators, said selected evaporator having the lowest or the highest detected control parameter, adjusting the share of the total mass flow of refrigerant distributed through the selected evaporator by a fixed amount, and adjusting the shares of the total mass flow distributed to the remaining evaporators to compensate for the adjustment of the mass flow distributed to the selected evaporator.

According to this embodiment, the evaporator which is operating most differently from the remaining evaporators is identified. The mass flow of refrigerant to the identified evaporator is then adjusted by a fixed amount in order to obtain that the evaporators are operated in a more similar manner. In this context the term 'fixed amount' means that the percentage of the available refrigerant which is distributed to the identified evaporator is adjusted by a fixed amount, i.e. a fixed number of percentage points.

In order to maintain the total mass flow of refrigerant through all the evaporators substantially constant, the mass flow of refrigerant through each of the remaining evaporators is adjusted in order to compensate the change in mass flow of refrigerant through the identified evaporator. This adjustment may advantageously be performed in such a manner that the mutual distribution between the remaining evaporators is substantially maintained.

According to a second aspect of the invention, the above and other objects are fulfilled by providing a method for controlling a refrigerant distribution in a vapour compression system, the vapour compression system comprising a compressor, a condenser, at least two evaporators fluidly connected in parallel between the compressor and a common outlet, and means for controlling a flow of refrigerant across each of the evaporators, the method comprising the steps of:

a) monitoring a superheat, SH, of refrigerant at the common outlet, b) modifying the distribution of refrigerant through the evaporators in such a manner that a mass flow of refrigerant through a first evaporator is altered by a predefined amount while keeping the total mass flow of refrigerant through all the evaporators substantially constant, c) detecting a control parameter based on the change in mass flow of refrigerant through the first evaporator obtained during step b), said control parameter reflecting a change in SH occurring as a result of the modification of the distribution of refrigerant, d) repeating steps a) to c) for each of the remaining evaporator(s), and e) adjusting the distribution of refrigerant through each of the evaporators on the basis of the detected control parameters.

It should be noted that a skilled person would readily recognise that any feature described in combination with the first aspect of the invention could equally be combined with the second aspect of the invention, and vice versa.

The method according to the second aspect of the invention is very similar to the method according to the first aspect of the invention, and features which have already been described above will therefore not be described in detail here. Instead reference is made to the description above.

In the method according to the second aspect of the invention steps b) and c) are performed in the following manner. First the mass flow of refrigerant through the first evaporator is altered by a predefined amount, i.e. in a known and controlled manner. This may be performed by increasing or decreasing the mass flow of refrigerant through the first evaporator by a fixed amount. Alternatively, it may be performed by varying the flow of refrigerant through the first evaporator in a known and controlled manner, e.g. following a sinusoidal pattern. During this, the mass flow of refrigerant through each of the remaining evaporators is also altered to compensate for the change in mass flow through the first evaporator, thereby keeping the total mass flow of refrigerant through all of the evaporators substantially constant. Furthermore, the SH is monitored during this step.

When the distribution of refrigerant has been modified as described above, a control parameter is detected. The control parameter reflects a change in SH occurring as a result of the modification of the distribution of refrigerant. The control parameter being detected may be found in the following manner. If the temperature of refrigerant is measured as a function of the length of an evaporator it will be found that the temperature of the refrigerant is substantially constant in parts of the evaporator where refrigerant is present in a liquid phase or in a mixed liquid/gaseous phase. At the position of the evaporator where the mixed phase ends and a purely gaseous phase starts, the temperature of the refrigerant starts increasing, and the increase in temperature continues until the outlet of the evaporator is reached. In the beginning the slope of the temperature curve is relatively steep, but the temperature will approach the temperature of the ambient air asymptotically, i.e. the slope will decrease as a function of position along the evaporator.

Accordingly, if the point where the mixed phase stops and the gaseous phase starts is relatively close to the outlet of the evaporator, a change in refrigerant supply, and thereby in the position of said point, must be expected to have a relatively significant impact on the temperature of refrigerant at the outlet. On the other hand, if said point is relatively far from the outlet, the impact on the refrigerant temperature at the outlet must be expected to be somewhat smaller, maybe even insignificant. A measured difference in temperature of refrigerant at the common outlet will therefore provide information as to how close to the outlet the point where the mixed phase stops and the gaseous phase starts is positioned. Since it is desired that said point is as close to the outlet as possible without allowing liquid refrigerant to pass through the evaporator, a measured temperature difference is a suitable control parameter.

Step e) may comprise determining which of the evaporators causes the most significant change in SH, and adjusting the distribution of refrigerant through the evaporators in such a manner that the share of the total amount of refrigerant distributed to said evaporator is adjusted more than adjustment(s) performed to the share of the total amount of refrigerant distributed to the remaining evaporator(s). It is desired to adjust the distribution in such a manner that all of the evaporators cause substantially equal changes in SH. It may be assumed that the evaporator which causes the most significant change in SH behaves differently than the other evaporators. Therefore it may be expected that adjusting the distribution of refrigerant in such a manner that the share of refrigerant distributed to this evaporator is adjusted most, will result in a distribution which causes the evaporators to behave in a more similar manner. For instance, as described above, an evaporator which is very close to maximum filling, i.e. with the point where the purely gaseous phase starts very close to the end of the evaporator, will have a significant impact on the refrigerant temperature at the common outlet in the case that the mass flow of refrigerant to that evaporator is altered. Furthermore, this evaporator is the one which is closest to allowing liquid to pass through the evaporator. Therefore, adjusting the distribution of refrigerant in such a manner that a smaller mass flow is distributed to that evaporator, and in such a manner that the mass flow through the remaining evaporators is increased to compensate this, will result in the identified evaporator obtaining a filling which is more similar to the filling of the remaining evaporators. Thereby the adjusted distribution is closer to an optimal situation. Furthermore, the risk of allowing liquid refrigerant to pass through one of the evaporators is reduced.

The method may further comprise the steps of comparing the control parameters obtained for each of the evaporators and determining, on the basis of said comparison, which of the evaporators is closest to a maximally filled position, and step e) may be performed in such a manner that the share of the total amount of refrigerant distributed to said evaporator is adjusted more than adjustment(s) performed to the share of the total amount of refrigerant distributed to the remaining evaporator(s). As mentioned above, in this case the evaporator which is closest to a maximally filled position should preferably be adjusted to receive a smaller share of the total amount of refrigerant.

The step of comparing the control parameters may comprise comparing the signs of the changes in SH for each of the evaporators. It may be expected that if the first evaporator has a high degree of filling, i.e. the point where the mixed phase ends and the gaseous phase starts is relatively close to the outlet of the evaporator, then the change in SH occurring as a result of the modification of the distribution of refrigerant performed in step b) will be dominated by the contribution from the change in mass flow through the first evaporator. On the other hand, if the degree of filling of the first evaporator is somewhat lower, then it must be expected that the change in SH will be dominated by the combined contribution from the change in mass flow through the remaining evaporators. Accordingly, if the mass flow of refrigerant through the first evaporator is of a kind which would result in a positive change in SH if the change in SH is dominated by the contribution from the first evaporator, and the measured change in SH is actually positive, then the change in mass flow through the first evaporator probably has a significant impact on the resulting measured SH. If, on the other hand, the measured change in SH is negative, then the combined contribution from the remaining evaporators must be expected to be more significant than the contribution from the first evaporator. Accordingly, the sign of the change in SH provides information as to how significant the impact on the measured SH is for the evaporator in question. Thus, comparing the signs in changes in SH for each of the evaporators will provide information as to the significance of each of the evaporators in this regard, as compared to the significance of the other evaporators.

As an alternative, the gradient of the change in SH or the amplitude of the SH may be used as a control parameter. This could, e.g., be suitable if the mass flow through the first evaporator is altered in a sinusoidal manner.

The method may further comprise the step of repeating steps a) to e). This may, e.g., be done by repeating steps a) to e) at predetermined time intervals. Alternatively, the method steps may be initiated by a superheat controller.

Step a) may comprise monitoring a temperature, T, of refrigerant at the common outlet, and/or step a) may comprise monitoring a pressure, P, of refrigerant at the common outlet. The pressure, P, of refrigerant at the common outlet may be obtained by measuring a temperature of refrigerant at a common inlet of the evaporators, or it may be measured directly.

The method may further comprise the steps of:

comparing the detected control parameters for each of the evaporators, and in the case that the detected control parameter of an evaporator is significantly different from the detected control parameters of the remaining evaporators, generating a failure warning signal to an operator.

The method may further comprise the step of initiating defrost of the evaporator having a significantly different control parameter upon generation of a failure warning signal.

The present invention may be applied in various types of refrigeration systems, including systems which have been constructed in a centralized manner, as well as systems which have been constructed in a decentralized manner. In the present context the term 'systems which have been constructed in a centralized manner' should be interpreted to mean systems, where one or more centrally positioned compressors supply refrigerant to multiple refrigeration sites. Examples of such systems include systems of the kind which is normally used in supermarkets, or of the kind used in certain industrial refrigeration systems.

Similarly, in the present context the term 'systems which have been constructed in a decentralized manner' should be interpreted to mean systems, where one or more compressors supply refrigerant to a single refrigeration site. Examples of such systems include refrigeration containers, air condition systems, etc.

BRIEF DESCRIPTION OF THE DRAWINGS

The invention will now be described in further detail with reference to the accompanying drawings in which.

DETAILED DESCRIPTION OF THE PREFERRED EMBODIMENTS

Figure 1:
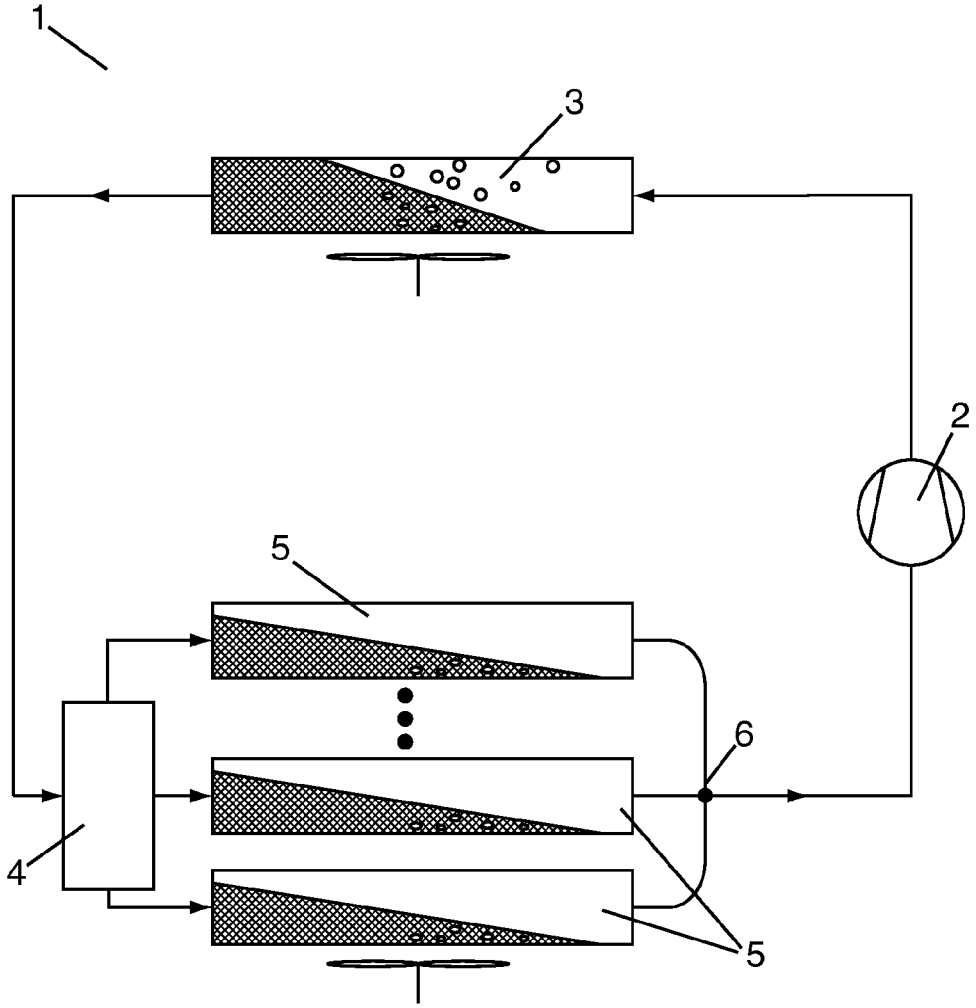
FIG. 1 is a diagrammatic view of a vapour compression system for use in a method according to an embodiment of the invention.

FIG. 1 is a diagrammatic view of a vapour compression system 1, such as a refrigeration system. The vapour compression system 1 comprises a compressor 2, a condenser 3, a valve 4 and a number of evaporators 5 (three of which are shown) connected to form a refrigerant circuit. The evaporators 5 are connected in parallel between the valve 4 and a common outlet 6 fluidly connected to the compressor 2, and the condenser 3 is coupled in series between the compressor 2 and the valve 4.

The valve 4 is of a kind which is capable of distributing refrigerant to each of the evaporators 5 in accordance with a distribution key which has previously been defined.

At the common outlet 6, or immediately downstream of the common outlet 6, a temperature sensor (not shown) is preferably arranged for measuring the temperature of refrigerant at this position. Thus, at the point of the temperature sensor, refrigerant which has passed through the various evaporators 5 has once again been mixed, and it is therefore the temperature of this mixed refrigerant which is measured. Accordingly, it can normally not be expected that information relating to the behaviour or performance of an individual evaporator 5 can be derived from such a temperature measurement. However, as described above, using the method according to the invention this is actually possible.

Figure 2:
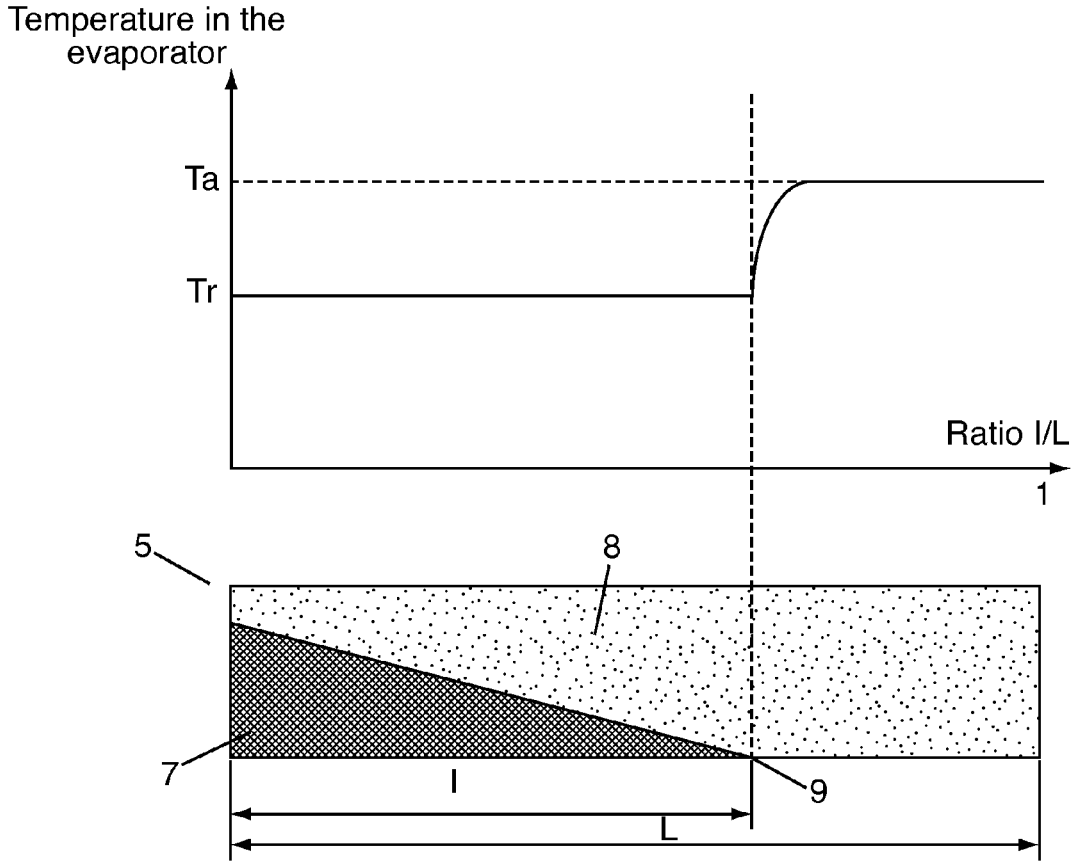
FIG. 2 illustrates the temperature of refrigerant in an evaporator as a function of position along the length of the evaporator.

FIG. 2. is a schematic view of an evaporator 5 and a graph of refrigerant temperature versus position along the length of the evaporator 5. The evaporator 5 contains refrigerant in a liquid phase 7 and in a gaseous phase 8. The part of the evaporator 5 illustrated with liquid phase 7 as well as gaseous phase 8 refrigerant should be interpreted as a part of the evaporator 5 containing refrigerant in a mixed phase.

At point 9 the mixed phase stops and a purely gaseous phase 8 occurs. The purely gaseous phase 8 continues until the end of the evaporator 5 is reached. This has the following impact on the temperature of the refrigerant.

As it is clear from the upper part of FIG. 2, the temperature of the refrigerant is maintained substantially constant at temperature $T_r$ in the region where mixed phase refrigerant is present in the evaporator 5. When the point 9 is reached, the refrigerant temperature starts increasing. Close to point 9 the increase is relatively steep, but when moving away from point 9, the increase in temperature slows down, and the temperature asymptotically approaches the temperature of the ambient air, $T_a$.

It can be seen from FIG. 2 that if the point 9 is far away from the end of the evaporator 5, then manipulating the mass flow of refrigerant through the evaporator 5 to slightly move the point 9 will not significantly affect the temperature of the refrigerant at the end of the evaporator 5. However, if the point 9 is very close to the end of the evaporator 5, then the temperature of the refrigerant will not yet have reached $T_a$, and manipulating the mass flow of refrigerant through the evaporator 5 to slightly move the point 9 will affect the temperature of the refrigerant at the end of the evaporator 5.

Figure 3:
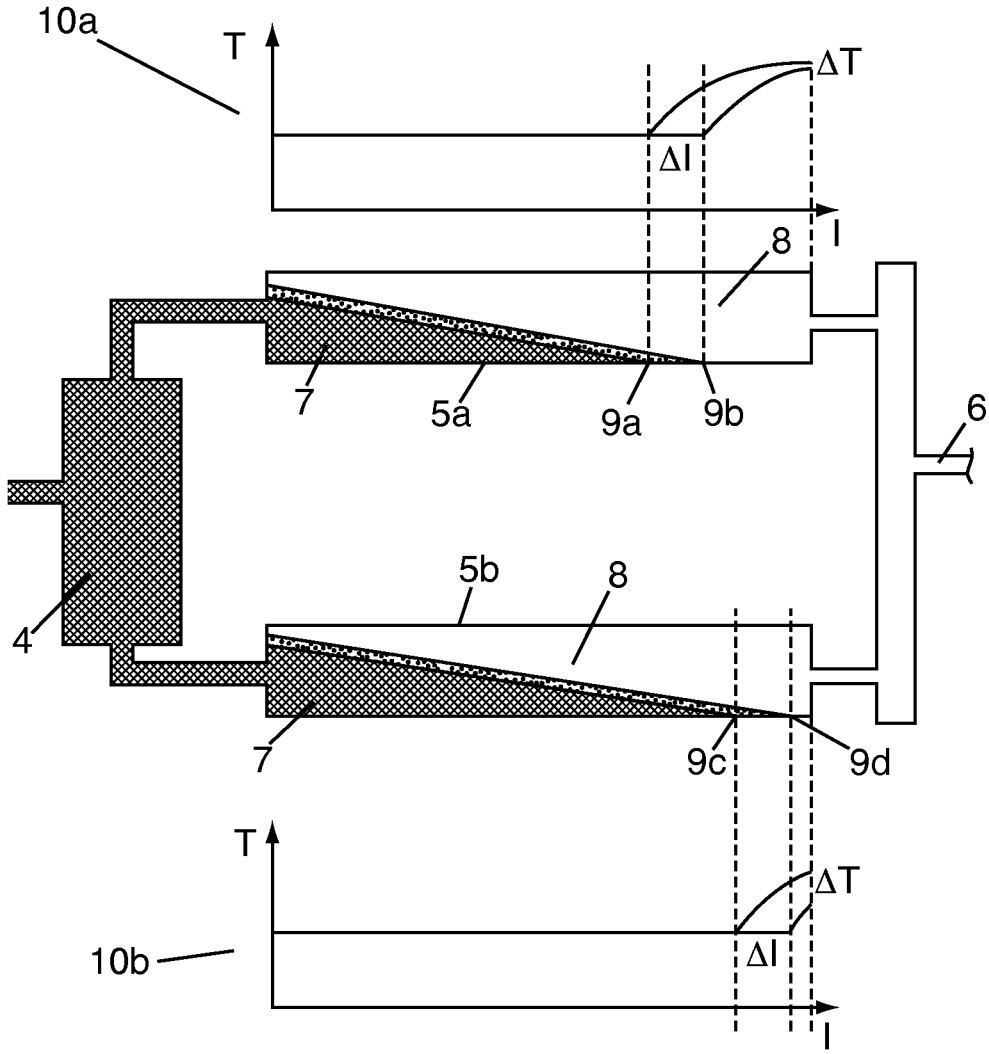
FIG. 3 is a diagrammatic view of part of a vapour compression system comprising two evaporators.

FIG. 3 is a diagrammatic view of part of a vapour compression system comprising two evaporators 5 fluidly connected in parallel between a valve 4 and a common outlet 6. FIG. 3 further illustrates the impact on the temperature of the refrigerant at the common outlet 6 when the distribution of refrigerant among the evaporators is modified to shift the position of a point 9 where the mixed phase stops and a purely gaseous phase 8 starts.

It can be seen from FIG. 3 that evaporator 5*b* is closer to maximum filling than evaporator 5*a*. If the mass flow of refrigerant distributed to evaporator 5*a* is altered in such a manner that point 9 is shifted by Δl, e.g. from point 9*a* to point 9*b*, the temperature of refrigerant at common outlet 6 changes by ΔT. As illustrated in graph 10*a*, ΔT is relatively small in this case because point 9 is positioned relatively far from the end of the evaporator 5*a*. Similarly, if the mass flow of refrigerant distributed to evaporator 5*b* is altered in such a manner that point 9 is shifted by the same amount, Δl, e.g. from point 9*c* to point 9*d*, then ΔT is somewhat larger as illustrated in graph 10*b*. Accordingly, altering the amount of mass flow of refrigerant through evaporator 5*b* by a certain amount will result in a more significant impact on the SH at the common outlet 6 than altering the amount of mass flow of refrigerant through evaporator 5*a* by the same amount. Thus, monitoring the temperature of refrigerant at the common outlet 6 while altering the distribution of refrigerant to the evaporators in a controlled manner will provide information about which evaporator is closest to a maximum filled position, and which evaporator is further away.

Figure 4:
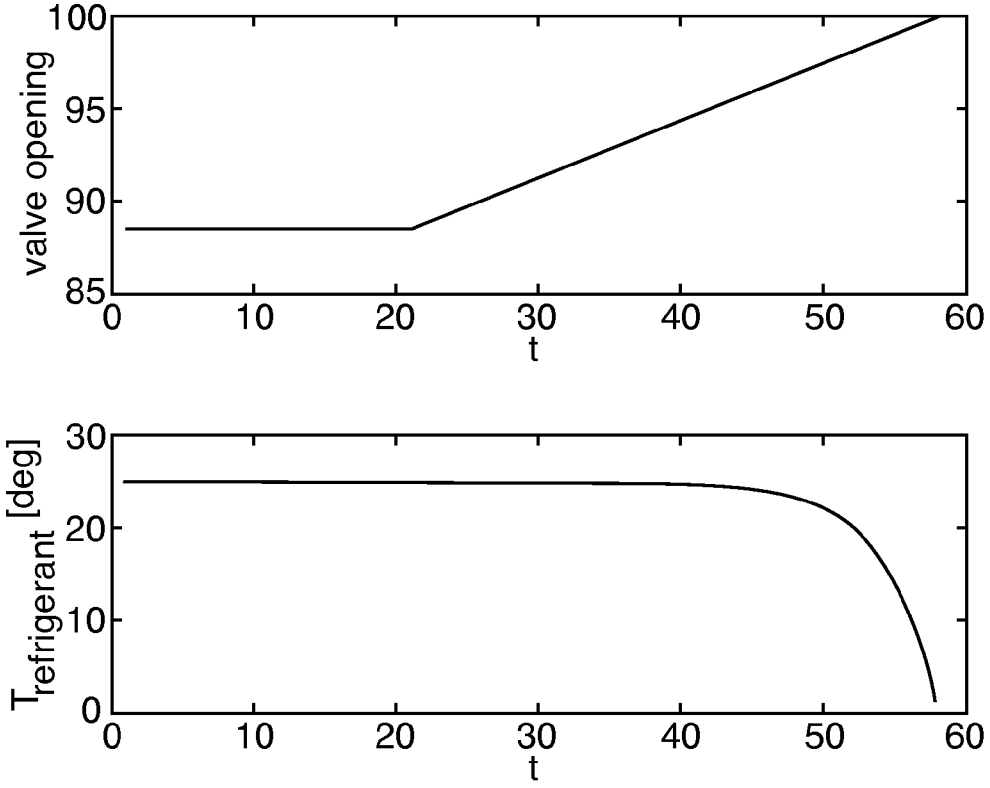
FIG. 4 illustrates the temperature of refrigerant at a common outlet of evaporators of a vapour compression system as a function of time, and in response to degree of opening of a valve connected to one of the evaporators.

FIG. 4 illustrates the temperature of refrigerant at a common outlet of evaporators of a vapour compression system as a function of time, and in response to degree of opening of a valve connected to one of the evaporators. The upper graph shows degree of opening of the valve as a function of time. It can be seen that the valve is initially kept at a constant, relatively low, degree of opening. At a certain time, a gradual increase in degree of opening is initiated. In accordance with an embodiment of the method according to the present invention, this gradual increase in degree of opening should be continued until a significant change in SH is detected.

The lower graph shows the temperature of refrigerant at the common outlet as a function of time, during the same time interval. It can be seen that while the degree of opening of the valve is kept at a constant, relatively low, level, the temperature of the refrigerant at the common outlet stays substantially constant at a relatively high level. Furthermore, the temperature stays at this level as the increase in degree of opening of the valve is initiated. However, when the degree of opening reaches a certain level, a dramatic decrease in the temperature occurs. This is an indication that the degree of opening of the valve has reached a level where it allows liquid refrigerant to pass through the evaporator, thereby causing a significant decrease in the refrigerant temperature at the common outlet, and thereby in SH. When this happens, the difference between the substantially constant degree of opening and the present degree of opening is detected. This difference in degree of opening can then be used as a control parameter, since it provides information as to how much the degree of opening of the valve can be increased before liquid passes through the evaporator, and thereby information relating to the degree of filling of the evaporator in question.

Figure 5:
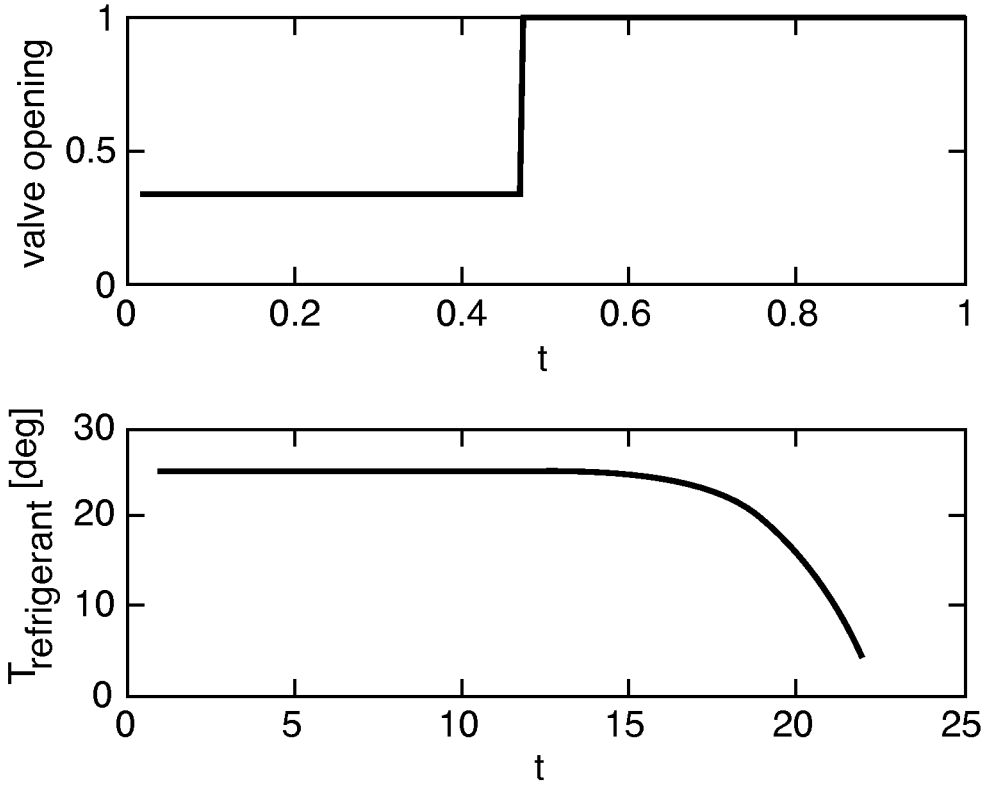
FIG. 5 illustrates the temperature of refrigerant at a common outlet of evaporators of a vapour compression system as a function of time in response to an abrupt opening of a valve connected to one of the evaporators.

FIG. 5 illustrates the temperature of refrigerant at a common outlet of evaporators of a vapour compression system as a function of time in response to an abrupt opening of a valve connected to one of the evaporators. The upper graph shows degree of opening of the valve as a function of time. It can be seen that the valve is initially kept at a constant, relatively low, degree of opening. At a certain time, the valve is opened fully in an abrupt manner. In accordance with an embodiment of the method according to the present invention, the system is then observed until a significant change in SH is detected.

The lower graph shows the temperature of refrigerant at the common outlet as a function of time, during the same time interval. It can be seen that while the degree of opening of the valve is kept at a constant, relatively low, level, the temperature of the refrigerant at the common outlet stays substantially constant at a relatively high level. Furthermore, the temperature stays at this level as the valve is abruptly opened. However, after a certain time interval has been allowed to lapse, a dramatic decrease in the temperature occurs. This is an indication that liquid refrigerant has been allowed to pass through the evaporator, similarly to the situation described above. When this occurs, the time which has elapsed since the valve was abruptly opened is detected and used as a control parameter. This is a suitable control parameter, since it provides information as to how close the liquid phase refrigerant is to the end of the evaporator in question, and thereby information relating to the degree of filling of said evaporator.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A method for controlling a refrigerant distribution in a vapour compression system, the vapour compression system comprising a compressor, a condenser, at least two evaporators fluidly connected in parallel between the compressor and a common outlet, and a a valve, which is capable of distributing refrigerant to each of the evaporators in accordance with previously defined amounts of available refrigerant for distribution as refrigerant mass flow between the at least two evaporators, for controlling a flow of refrigerant across each of the evaporators, the method comprising the steps of:

a) monitoring a superheat, SH, of refrigerant at the common outlet only, said monitoring of a superheat, SH, being performed by either one of: monitoring a temperature, T, of refrigerant at the common outlet only or monitoring a pressure, P, of refrigerant at the common outlet only, b) modifying the distribution of refrigerant through the evaporators in such a manner that a mass flow of refrigerant through a first evaporator is altered while keeping the total mass flow of refrigerant through all the evaporators constant, c) when a significant change in superheat SH occurs, detecting a control parameter based on the change in mass flow of refrigerant through the first evaporator obtained during step b), wherein the significant change in superheat SH is either one of: 1) a sudden decrease in superheat SH that is prompted by liquid refrigerant being allowed to pass through the first evaporator, or 2) a sudden increase in superheat SH that is prompted by gaseous refrigerant being allowed to pass through the first evaporator, wherein said control parameter is either one of: 1) a difference in a degree of opening of the valve, which provides information about how much the mass flow of refrigerant through the first evaporator has been increased and which provides information as to how much the degree of opening can be increased before liquid refrigerant passes through the evaporator, or 2) a length of a time interval elapsing until the significant change in superheat SH occurs, which provides information as to how long it takes from fully opening a valve until liquid refrigerant passes through the evaporator, d) repeating steps a) to c) for each of the remaining evaporator(s), and e) adjusting the distribution of refrigerant through each of the evaporators on the basis of the detected control parameters.

2. The method according to claim 1, wherein step b) comprises gradually increasing a mass flow of refrigerant through the first evaporator.

3. The method according to claim 2, wherein the step of gradually increasing a mass flow of refrigerant comprises gradually opening a valve being fluidly connected to said evaporator.

4. The method according to claim 3, wherein the detected control parameter is the difference in a degree of opening of a valve, which is capable of distributing refrigerant to each of the evaporators in accordance with the previously defined amounts of available refrigerant for distribution as refrigerant mass flow between the at least two evaporators.

5. The method according to claim 1, wherein the control parameter is a length of a time interval elapsing until the significant change in superheat SH occurs.

6. The method according to claim 1, further comprising the step of repeating steps a) to e).

7. The method according to claim 6, wherein steps a) to e) are repeated at predetermined time intervals.

8. The method according to claim 6, wherein the method steps are initiated by a superheat controller.

9. The method according to claim 1, wherein the pressure, P, of refrigerant at the common outlet is obtained by measuring a temperature of refrigerant at a common inlet of the evaporators.

10. The method according to claim 1, further comprising the steps of:

comparing the detected control parameter of the evaporator with control parameters of the other evaporators of the system, and in the case that the detected control parameter of an evaporator is different from the detected control parameters of the remaining evaporators, generating a failure warning signal to an operator.

11. The method according to claim 10, further comprising the step of initiating defrost of the evaporator having a different control parameter upon generation of a failure warning signal.

12. The method according to claim 1, wherein step e) is performed by adjusting the distribution of refrigerant through each of the evaporators in accordance with a distribution defined by the detected control parameters.

13. The method according to claim 1, wherein step e) comprises:

selecting one of the evaporators, said selected evaporator having the lowest or the highest detected control parameter, adjusting the share of the total mass flow of refrigerant distributed through the selected evaporator by a fixed amount, and adjusting the shares of the total mass flow distributed to the remaining evaporators to compensate for the adjustment of the mass flow distributed to the selected evaporator.

14. A method for controlling a refrigerant distribution in a vapour compression system, the vapour compression system comprising a compressor, a condenser, at least two evaporators fluidly connected in parallel between the compressor and a common outlet, and a a valve, which is capable of distributing refrigerant to each of the evaporators in accordance with previously defined amounts of available refrigerant for distribution as refrigerant mass flow between the at least two evaporators, for controlling a flow of refrigerant across each of the evaporators, the method comprising the steps of:

a) monitoring a superheat, SH, of refrigerant at the common outlet only, said monitoring of a superheat, SH, being performed by either one of: monitoring a temperature, T, of refrigerant at the common outlet only or monitoring a pressure, P, of refrigerant at the common outlet only, b) modifying the distribution of refrigerant through the evaporators in such a manner that a mass flow of refrigerant through a first evaporator is altered by a predefined amount while keeping the total mass flow of refrigerant through all the evaporators constant, c) detecting a control parameter based on the change in mass flow of refrigerant through the first evaporator obtained during step b), said control parameter reflecting a significant change in superheat SH occurring as a result of the modification of the distribution of refrigerant, wherein the significant change in superheat SH is either one of: 1) a sudden decrease in superheat SH that is prompted by liquid refrigerant being allowed to pass through the first evaporator, or 2), a sudden increase in superheat SH that is prompted by gaseous refrigerant being allowed to pass through the first evaporator, wherein said control parameter is either on of: 1) a difference in a degree of opening the valve, which provides information about how much the mass flow of refrigerant through the first evaporator has been increased and which provides information as to how much the degree of opening can be increased before liquid refrigerant passes through the evaporator, or 2) a length of a time interval elapsing until the significant change in superheat SH occurs, which provides information as to how long it takes from fully opening a valve until liquid refrigerant passes through the evaporator, d) repeating steps a) to c) for each of the remaining evaporator(s), and e) adjusting the distribution of refrigerant through each of the evaporators on the basis of the detected control parameters.

15. The method according to claim 14, wherein step e) comprises determining which of the evaporators causes the most change in superheat SH, and adjusting the distribution of refrigerant through the evaporators in such a manner that the share of the total amount of refrigerant distributed to said evaporator is adjusted more than adjustment(s) performed to the share of the total amount of refrigerant distributed to the remaining evaporator(s).

16. The method according to claim 14, further comprising steps of comparing the control parameters obtained for each of the evaporators and determining, on the basis of said comparison, which of the evaporators is closest to a maximally filled position, where the purely gaseous phase starts at the end of the evaporator, and wherein step e) is performed in such a manner that the share of the total amount of refrigerant distributed to said evaporator is adjusted more than adjustment(s) performed to the share of the total amount of refrigerant distributed to the remaining evaporator(s).

17. The method according to claim 16, wherein the step of comparing the control parameters comprises comparing signs of the changes in superheat SH for each of the evaporators, said signs indicating that the distribution of refrigerant among the evaporators is not optimal, and where distribution of refrigerant among the evaporators is not optimal in either one the following situations: If the mass flow of refrigerant through one evaporator is of a kind which would result in a positive change in superheat SH if the change in superheat SH is dominated by the contribution from the first evaporator, and the measured change in superheat SH is positive, or if the mass flow of refrigerant through one evaporator is of a kind which would result in a negative change in superheat SH, a combined contribution from the remaining evaporators is more significant than the contribution from the one evaporator.

18. The method according to claim 14, further comprising the step of repeating steps a) to e).

19. The method according to claim 18 wherein steps a) to e) are repeated at predetermined time intervals.

20. The method according to claim 18, wherein the method steps are initiated by a superheat controller.

21. The method according to claim 14, wherein step a) comprises monitoring a temperature, T, of refrigerant at the common outlet.

22. The method according to claim 14, wherein step a) comprises monitoring a pressure, P, of refrigerant at the common outlet.

23. The method according to claim 22, wherein the pressure, P, of refrigerant at the common outlet is obtained by measuring a temperature of refrigerant at a common inlet of the evaporators.

24. The method according to claim 14, further comprising the steps of:

comparing the detected control parameter of the evaporator with control parameters of the other evaporators of the system, and in the case that the detected control parameter of an evaporator is different from the detected control parameters of the remaining evaporators, generating a failure warning signal to an operator.

25. The method according to claim 24, further comprising the step of initiating defrost of the evaporator having a different control parameter upon generation of a failure warning signal.

* * * * *

UNITED STATES PATENT AND TRADEMARK OFFICE

CERTIFICATE OF CORRECTION

PATENT NO. : 8,769,976 B2
APPLICATION NO. : 12/663040
DATED : July 8, 2014
INVENTOR(S) : Claus Thybo et al.

It is certified that error appears in the above-identified patent and that said Letters Patent is hereby corrected as shown below:

In the Claims:

Claim 14, Column 13, line 66, delete “significant” before “change”.

Claim 14, Column 14, line 1, delete “significant” before “change”.

Signed and Sealed this
Ninth Day of December, 2014

Michelle K. Lee

Michelle K. Lee
*Deputy Director of the United States Patent and Trademark Office*